US005357887A

United States Patent [19]

Fenzl

[11] Patent Number: 5,357,887

[45] Date of Patent: Oct. 25, 1994

[54] SEWING UNIT FOR THE PRODUCTION OF A SEAM

[75] Inventor: Horst Fenzl, Oerlinghausen, Fed. Rep. of Germany

[73] Assignee: Durkopp Adler AG, Fed. Rep. of Germany

[21] Appl. No.: 112,420

[22] Filed: Aug. 27, 1993

[30] Foreign Application Priority Data

Aug. 31, 1992 [DE] Fed. Rep. of Germany ..... 4228943

[51] Int. Cl.[5] ..... D05B 21/00

[52] U.S. Cl. ..... 112/121.15; 112/311

[58] Field of Search ..... 112/121.15, 121.12, 112/102, 2, 311

[56] References Cited

U.S. PATENT DOCUMENTS

| | | | |
|---|---|---|---|
| 3,522,783 | 8/1970 | Pollmeir | 112/121.15 |
| 3,889,613 | 6/1975 | Hofland | 112/121.15 |
| 5,029,542 | 7/1991 | Ferguson | 112/121.15 X |

FOREIGN PATENT DOCUMENTS 1660839 5/1971 Fed. Rep. of Germany .

*Primary Examiner*—Clifford D. Crowder
*Assistant Examiner*—Paul C. Lewis
*Attorney, Agent, or Firm*—Ostrolenk, Faber, Gerb & Soffen

[57] ABSTRACT

A sewing unit (1) for producing a seam in a sewing-material part (92), in particular for the production of a dart seam in an article of clothing, has a sewing-material holder (45) which receives the sewing-material part (92) between two plate edge parts (54, 55) and moves it via a displacement drive (44) along a sewing machine (2). The sewing-material holder (45) is provided with plate edge parts (54, 55) which frictionally smooth the sewing-material part (92) as it is being fed by a feeding plate (11) into the sewing-material holder (45) which is then placed in its clamping position. This eliminates any need for a further transfer of the sewing-material part 92 to a clamping rail for guiding it along the sewing machine 2. The plate edge parts (54, 55) serve, in the clamped position of the sewing-material part (92), for holding the sewing-material part (92) during the sewing process.

13 Claims, 4 Drawing Sheets

SEWING UNIT FOR THE PRODUCTION OF A SEAM

BACKGROUND OF THE INVENTION

The present invention relates to a sewing unit for the production of a seam.

A sewing unit for producing a seam in a sewing-material part generally includes a sewing machine, a sewing-material holder, which is displaceable relative to the sewing machine, a setting drive for positioning the sewing-material holder in an open position in which the sewing-material part is not grasped and a clamping position in which the sewing-material part is grasped, and a feeding plate for feeding the sewing-material part into the sewing-material holder with the sewing-material part folded around the feeding plate. The feeding plate holding the sewing-material-part is movable in a feeding direction (or a Y-axis) into the sewing-material holder which is in its open position and, after transfer of the sewing-material part and closing of the sewing-material holder, the feeding plate can be moved out alone from the sewing-material holder.

From Federal Republic of Germany Patent 16 60 839 (corresponding to U.S. Pat. No. 3,522,783) a sewing system is known in which a sewing-material part is transferred by means of a plate from a presentation station to an intermediate station, clamped there, and then taken over by a sewing-material holder and moved through a sewing machine in order to produce a seam. In order to obtain precise fixing and alignment of the sewing-material part, a tram rail is arranged in front of the intermediate station, which rail, during the feeding of the sewing-material part, rubs against the latter and thereby smooths it.

This operation requires a considerable structural expense in order to provide the different parts involved. Furthermore, it is necessary for the process that specific operations take place one after the other, resulting in considerable machine cycle time.

SUMMARY OF THE INVENTION

The main object of the present invention is therefore to develop the known sewing system in such a manner that its structural construction is simplified and its machine cycle time is shortened.

This object may be achieved by a sewing unit in accordance with an embodiment of the invention, by which a sewing unit is provided of simple construction and accordingly low manufacturing cost, in which successive operations are substantially avoided and thus a reduction in the machine cycle time is achieved. In this case, the sewing-material holder has two plate edge parts which are arranged for being resiliently urged with respect to each other and which frictionally engage the sewing-material part as it is being fed between them.

The sewing-material holder may also have clamping plates which are movably connected to each other and have clamping zones in the region of the seam, the clamping plates being arranged in the feeding direction (Y-axis) behind the plate edge parts. This leads to an even more reliable transfer and clamping of the sewing-material part.

Preferably the plate edge parts, in the open position of the clamping plates, do not contact each other. These features permit a distortion-free removal of the completely sewn sewing-material part from the sewing unit.

The construction is particularly simple if the plate edge parts are connected via straps to the clamping plates; if the straps are developed as leaf springs; and especially if the clamping plate, the straps, and the plate part are all developed as a single piece of metal.

The setting drive advantageously is a three-position drive having an intermediate third position in which the clamping plates are in an intermediate position such that the plate edge parts, but not the clamping plates, come into contact with the sewing-material part, as it is being fed. This enables the sewing-material part to be smoothed while feeding.

The three-position drive desirably has a control cam associated with the clamping plates and a pneumatic cylinder which is movable relative to the clamping plates, whereby an inexpensive three-position drive for the clamping plates is obtained.

The sewing-material part is held particularly dependably for formation of the seam, if the clamping zone extends on both sides of the seam to be produced, and especially if the clamping zone bears an adhesive covering.

Other features and advantages of the present invention will become apparent from the following description of the invention which refers to the accompanying drawings.

DETAILED DESCRIPTION OF AN EMBODIMENT OF THE INVENTION

Figure 1:
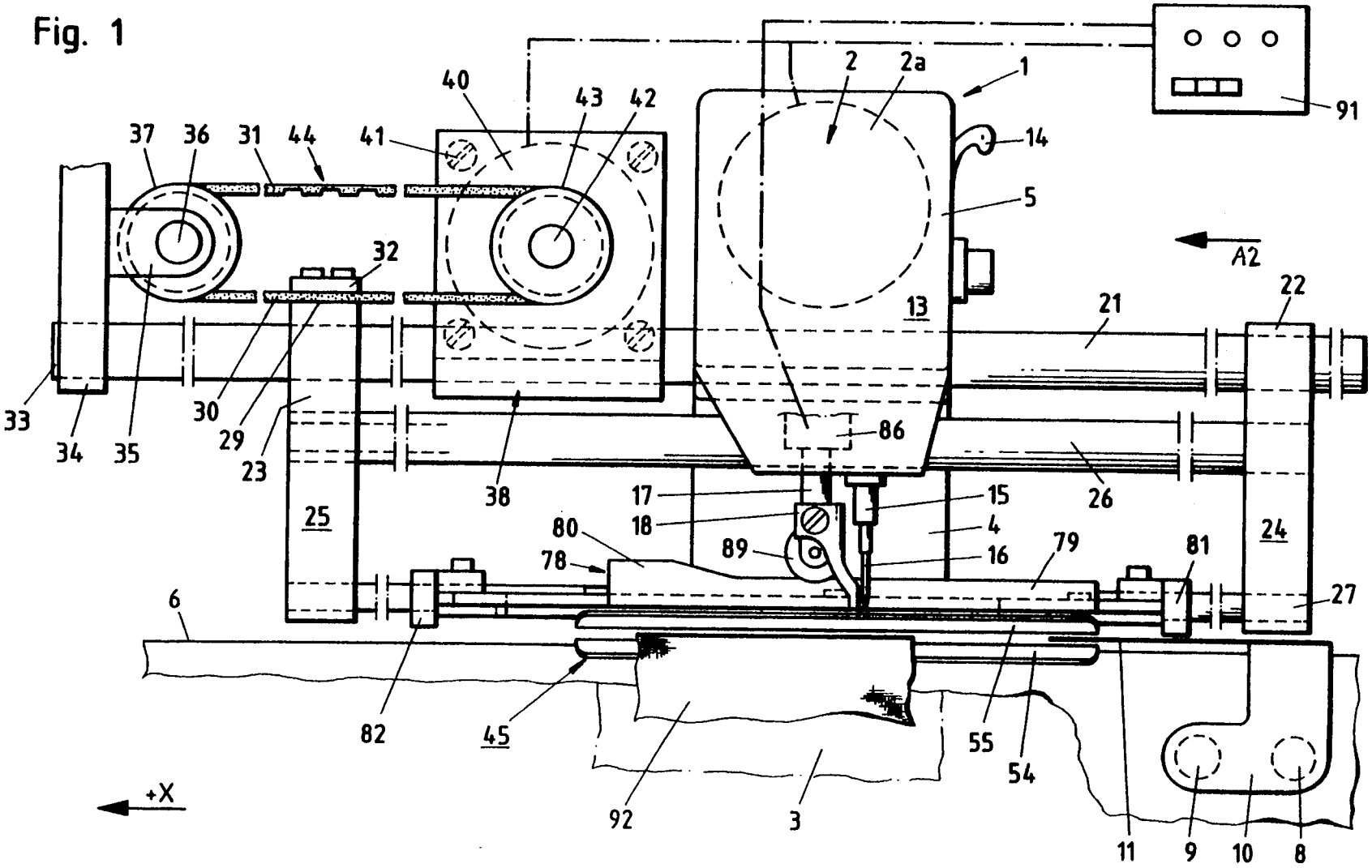
FIG. 1 is a front view of the sewing system of the invention.

The sewing unit 1 shown in FIG. 1 is provided with a sewing machine 2 which, in conventional manner, has a base plate 3 and a stand 4 which adjoins it, and has an arm 5. The base plate 3 and the arm 5 of the sewing machine 2 extend in the direction of a Y-axis.

The sewing machine 2 is fastened on the base plate 3 by a frame (without reference numeral) of the sewing unit 1. The base plate 3 has a top which is referred to as resting surface 6. Within the base plate 3, a shuttle 7 is turnably mounted and a thread-cutting device (not provided with reference numeral) is arranged. Furthermore, two ends of rods 8 and 9 are received displaceably in the base plate 3, their free ends being firmly connected to a support 10. On the free end of the support 10 is firmly screwed a feeding plate 11 which is made of steel sheet of a thickness of 1.5 mm and has an edge 12. The plate 11 is polished on both sides and tapers down towards the edge 12 to a thickness of 0.4 mm.

The arm 5 of the sewing machine 2 ends in customary manner in a head 13 in which there is provided a crank drive for driving a thread lever 14 and a needle 15 which is mounted for up and down displacement and has a needle 16 fastened to it. The base plate 3 is provided in customary manner with a throat plate (not provided with reference numeral) having a throat hole through which the needle 16 passes and cooperates with the shuttle 7. A bar 17 on which a presser foot 18 is firmly screwed is furthermore received in the head 13 for displacement parallel to the needle bar 15. The bar 17, including the presser foot 18 fastened to it, can be shifted in its vertical position via a setting drive, not shown. For driving the sewing machine 2, an ordinary commercial positioning motor **2*a* is mounted on a flange on the end of the arm 5**.

On the arm 5, on a mounting surface 19 directed towards the base plate 3, there is firmly fastened (by screws not shown) a bearing bracket 20 on which a guide bar 21 is fastened. The guide bar 21 extends in an X-axis directed at right angles to the Y-axis in accordance with FIG. 1. On the guide bar 21, bearing lugs 22, 23, which are the ends of levers 24 and 25, are received so as to be turnable and displaceable in the direction of the X-axis. The levers 24, 25 are rigidly connected with each other by means of a tube 26 and a bar 27 and form as a whole a slide frame 28. The lever 25 is developed with a screw-mounting surface 29 in the region of the bearing lug 23 on which surface a portion 30 of a toothed belt 31 is firmly screwed by means of a plate 32 and screws not shown in detail.

At one end 33 of the guide bar 21 there is rigidly received a bearing piece 34 on which a fork-shaped bearing 35 is developed. Within the fork-shaped bearing 35 a toothed-belt pulley 37 is mounted for free rotation via a shaft 36, the pulley receiving the toothed belt 31. Furthermore, on the guide bar 21, in the region directly behind the arm 5 of the sewing machine 2 in the direction of the X-axis there is rigidly received a bearing 38 which is developed with a screw-mounting surface 39 and a hole, not shown in detail. A drive motor in the form of a stepping motor 40 is firmly attached on the screw-mounting surface 39 by screws 41 on the bearing 38. The stepping motor 40 is provided with a drive shaft 42 which passes through the hole (not shown in detail) in the bearing 38 and is connected firmly at its end to a toothed-belt pulley 43. The toothed belt 31 is received in form-locked manner on the latter, in a tensioned condition, due to a suitable axial distance between the toothed-belt pulleys 37 and 43. The parts described above, as well as the toothed-belt pulleys 37, 43 and the toothed belt 31 received on them, form a displacement drive 44. By this construction it is assured that the portion 30 of the toothed belt 31 extends parallel to the guide bar 21.

Figure 2:
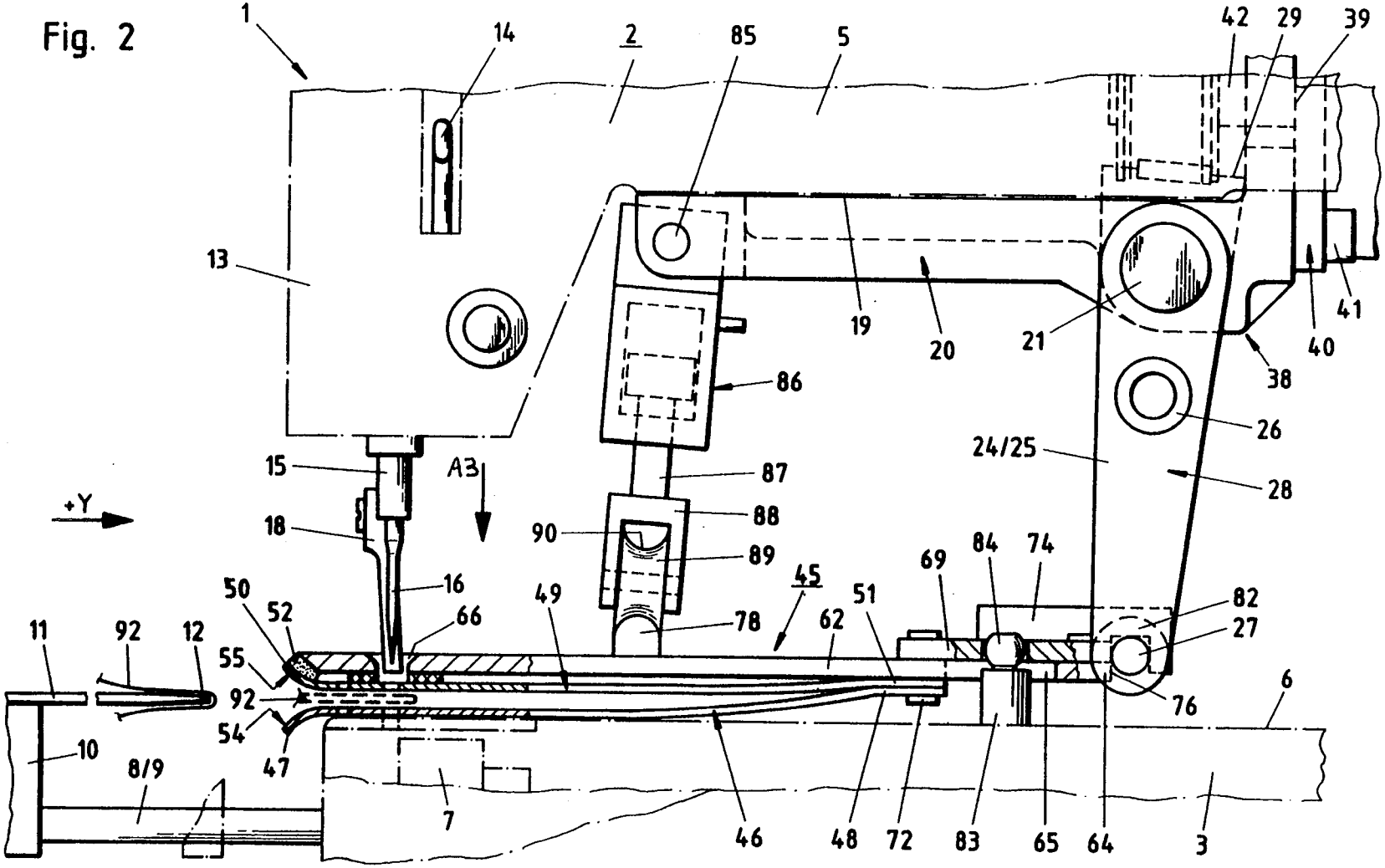
FIG. 2 is a side view of the sewing system on a larger scale, seen in the direction indicated by the arrow A2 in FIG. 1, with the sewing-material holder shown partially in cross-section.

In accordance with FIG. 2, a sewing-material holder 45 having a lower clamping plate 46 rests on the resting surface 6 of the base plate 3. The lower clamping plate 46 ends on the one hand in a radially bent free end 47 facing the plate 11 and, on the other hand, in a bent mounting end 48. As can further be noted from FIG. 2, there is provided on the sewing-material holder 45 an upper clamping plate 49 which has a radially bent end free 50 developed as a mirror image to the free end 47 and a bent mounting end 51. The end 50 has a rubber strip 52 glued to it over its entire width.

Figure 3:
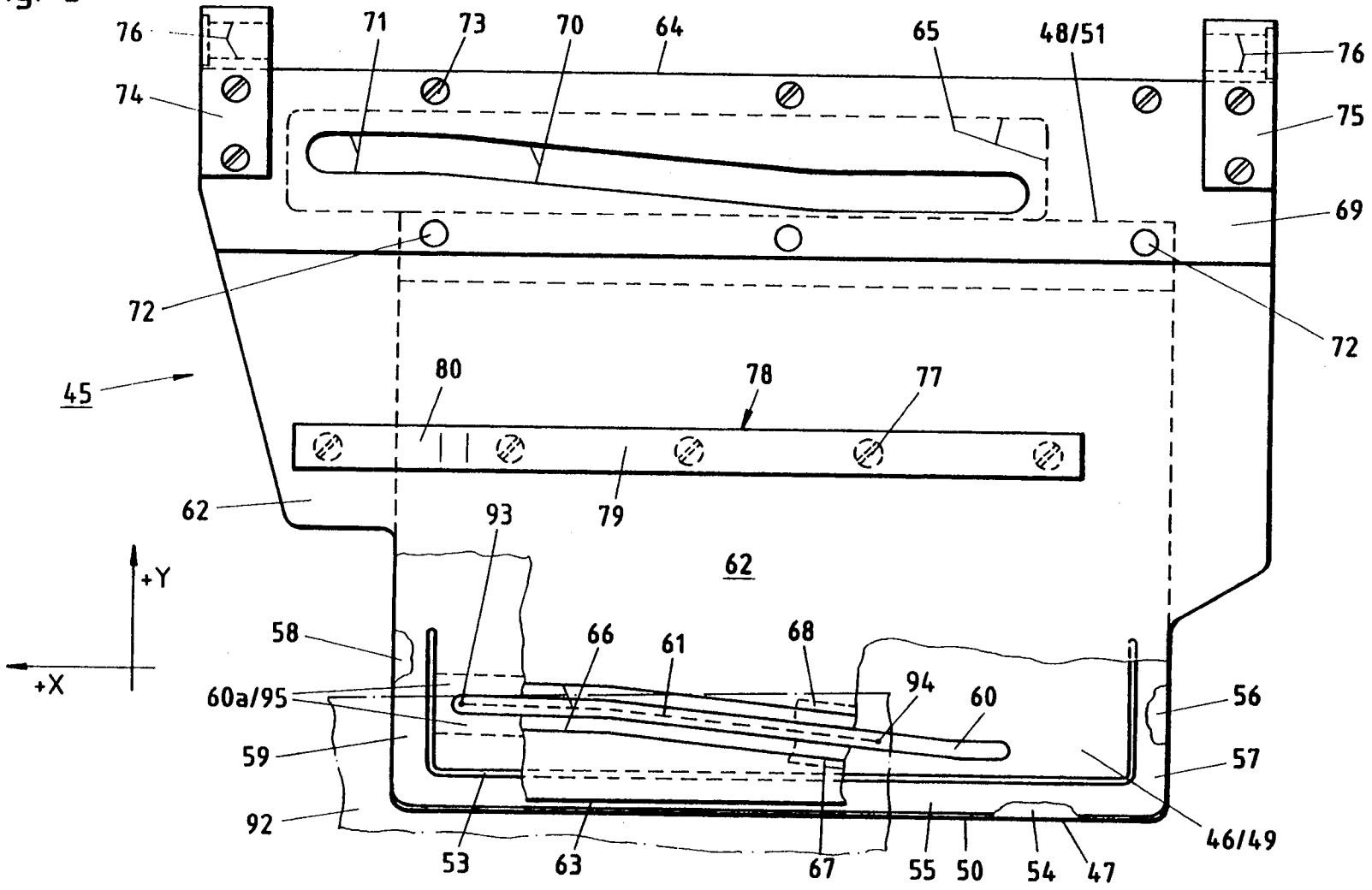
FIG. 3 is a view of the sewing-material holder as seen in the direction of the arrow A3 in FIG. 2, on a larger scale.

In accordance with FIG. 3, each of the clamping plates 46, 49 is developed with a slot 53 which is about 1 mm wide and has a U-shape so as to define plate edge parts 54 and 55 which face the plate 11 and include the free ends 47 and 50. The arrangement of the slot 53 in the clamping plates 46 and 49, simultaneously forms straps 56, 57, 58 and 59, by which the parts 54, 55 are thus connected to the clamping plates 46, 49. By this development, the clamping plates 46 and 49, straps 56, 57, 58 and 59 and plate parts 54 and 55, are formed from a single piece of sheet metal.

Figure 4:
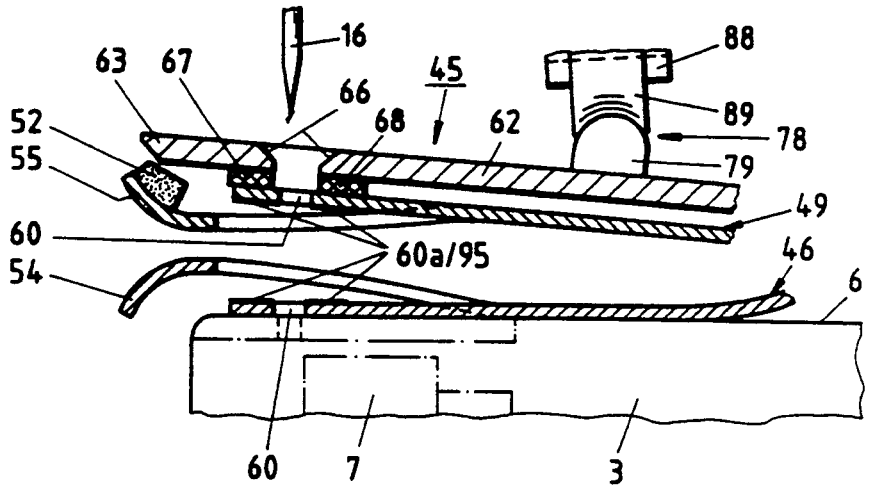
FIG. 4 corresponds to part of FIG. 2, and shows the sewing-material holder in its completely open condition, which is its position after removal of the completely sewn sewing-material part.
Figure 5:
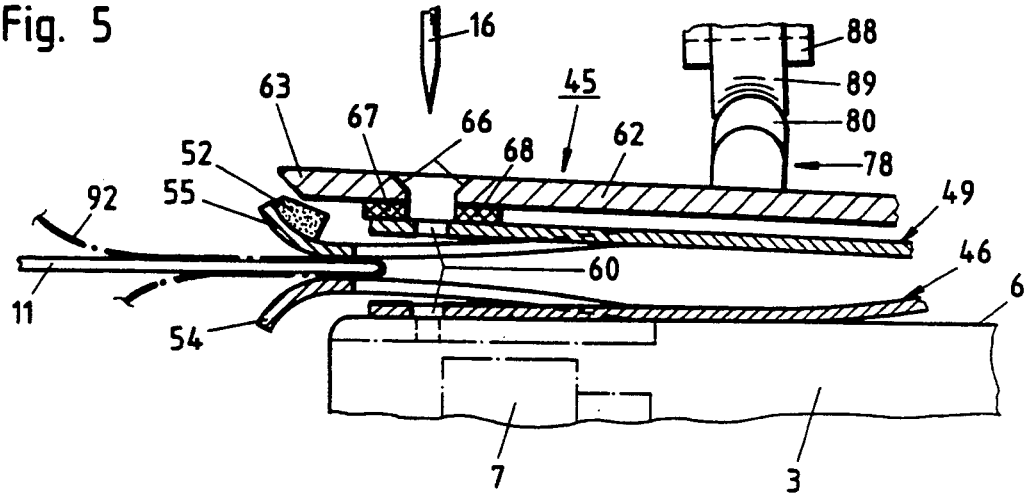
FIG. 5 corresponds to FIG. 4, and shows the sewing-material holder in its intermediate partially closed condition, with the feeding plate entering between the clamping plates, carrying the partially fed sewing-material part.

Furthermore, in both the lower clamping plate 46 and the upper clamping plate 49 there is a cut-out 60 which has a contour corresponding to the desired course of a seam 61. The regions on the facing sides of the clamping plates 46, 49 which extend 4 to 8 mm on both sides of the cut-out 60 are designated as clamping zones **60*a* (FIGS. 3 and 4**).

The clamping plates 46 and 49 are provided with holes (not provided with reference numeral) in the regions of the ends 48 and 51, through which holes rivets 72 extend, as will be described further below.

The sewing-material holder 45 furthermore has a pressure plate 62 which is made of aluminum sheet of a thickness of about 4 mm. The pressure plate 62 is limited in the direction of the Y-axis by a beveled front edge 63 and a back edge 64 near which is formed a rectangular recess 65. Furthermore, the pressure plate 62 has a funnel-shaped opening 66 corresponding to the course of the recess 60. On both sides of the opening 66, strips 67, 68 of elastic material, for instance sponge rubber of a thickness of 2 mm, are glued to the pressure plate 62, on the side facing the upper clamping plate 49.

Near the back of the sewing-material holder 45 is a rectangular plate 69 which is made, for instance, of laminated plastic. It is developed with a curved slot 70 which corresponds, with the exception of an end region 71 extending in the direction of X-axis, to the course of the seam 61.

As can be noted from FIGS. 2 and 3, the pressure plate 62, the plate 69 and clamping plates 46, 49 are rivetted to each other by rivets 72. In addition, the pressure plate 62 and the plate 69 are screwed together by screws 73. Furthermore, the pressure plate 62 and the plate 69 are screwed at their ends directed in the direction of the X-axis to a pair of similarly developed bearing pieces 74, 75. Each of the latter is provided with a U-shaped recess 76 which is open towards the resting surface 6 of the base plate 3.

Furthermore, a cam 78 is fastened by screws 77 to the pressure plate 62, said cam having a semicircular profile. The cam 78 is developed with a lower part 79 and a higher part 80 adjoining it. The length of the higher part 80 corresponds to the length of the end region 71 of the slot 70.

The bearing pieces 74 and 75 grip over the bar 27 on which they are turnable but are secured axially and radially by collar-like retainer rings 81 and 82. On the base plate 3 of the sewing machine 2 there is provided a pin 83 on the end of which a spherical roller 84 is rotatably mounted. It extends with play into the curved slot 70 of the plate 69.

A setting drive 86 which is, for example, a single-acting pneumatic cylinder is swingably supported on the bearing bracket 20 on a bolt 85 extending in the direction of the X-axis. The setting drive 86 has a piston rod 87 with a fork-shaped bearing piece 88 in which a roller 89 is mounted turnably on a bolt. This roller is developed with a semicircular circumferential groove 90 which corresponds essentially to the profile of the cam 78. The setting drive 86, in combination with the cam 78 which serves as a control cam, forms a three-position drive which makes it possible to position the sewing-material holder 45 in a free position, a clamped position, and an intermediate position lying between them, as will be described further below.

The clamping plates 46 and 49 are made of spring steel of a thickness of about 1 mm. By suitably shaping the clamping plates 46, 49, an initial tension is built-up in them when the sewing-material holder 45 is installed on the sewing machine 2 as shown in FIGS. 1, 2 and 4–6. In this condition, the lower clamping plate 46 is pressed by initial tension against the resting surface 6 and the upper clamping plate 49 by an initial tension against the pressure plate 62, which, in its turn, rests against the roller 89. Furthermore, the straps 56–59 which function as leaf springs are so shaped that the plate edge parts 54 and 55 can, in the free position (FIG. 4), be brought into a position in which they are not in contact with each other, but nevertheless are closer to each other than the clamping plates 46, 49.

The sewing unit 1 furthermore includes a control unit 91, including operating elements, a pneumatic unit and switch, which is connected via dash-dot lines without reference numerals to the positioning drive 2*a*, the stepping motor 40, and the setting drive 86 as well as to the setting drive for the presser foot.

The manner of operation of the sewing unit 1 is as follows:

a) Sewing-material holder setting drive:

The setting drive 86 is so dimensioned that the sewing-material holder 45 assumes the free position shown in FIG. 4, which is its completely open position, when the roller 89 rests against the low part 79 of the cam 78, when the setting drive 86 is not acted on by compressed air, and therefore when the piston rod 87 of the setting drive 86 is displaced by the initial tension in the clamping plates 46, 49 into its retracted end position.

Figure 6:
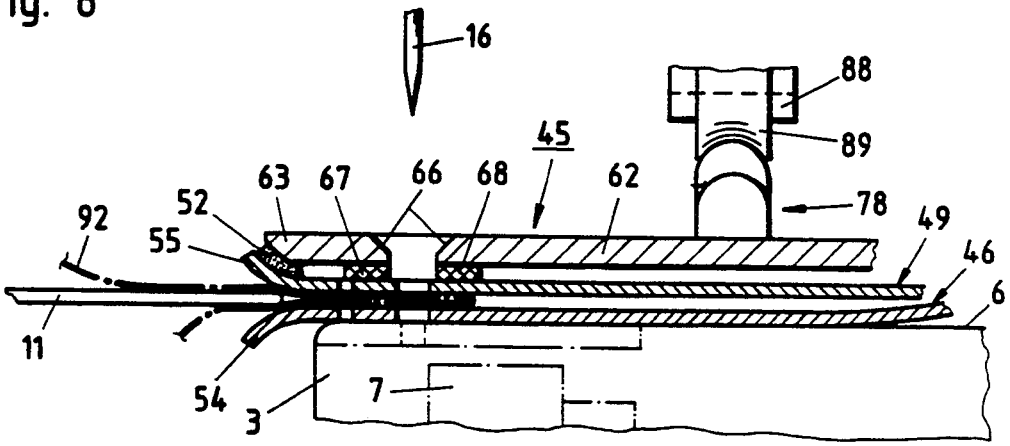
FIG. 6 corresponds to FIGS. 4 and 5, and shows the sewing-material holder in completely closed condition, the feeding plate being in the process of moving out from between the plates, and the sewing-material part being clamped in the sewing-material holder.

Furthermore, the setting drive 86 is so dimensioned that the sewing-material holder 45 assumes the clamped position shown in FIG. 6, and therefore its completely closed position, when the setting drive 86 is acted on by compressed air and the roller 48 rests against the low part 79 or the high part 80 of the cam 78. It is pointed out that the holding function of the clamping plates 46, 49 and of the plate edge parts 54, 55 in the clamping position is favored, in particular, by the elastic strips 67, 68 and the rubber strip 52, as a result of which the holding force at the clamping zones 60 is increased and changes in the holding force as a result of varying thicknesses of the sewing material are reduced.

On basis of the dimensioning of the cam 78, it is possible to position the sewing-material holder 45 in an intermediate position (FIG. 5) lying between the free position and the clamped position, and therefore in a middle position, when the roller 82 rests against the high part 80 of the curved piece 78, when the setting drive 86 is not acted on by compressed air, and when the piston rod 87 of the setting drive 86 is displaced into its retracted end position by the initial tension in the clamping plates 46, 49. The intermediate position is characterized by the fact that the plate edge parts 54, 55 are pressed together with initial tension, i.e. they rest resiliently against each other, while the clamping plates 46, 49 are positioned at a distance of a few millimeters from each other.

b) Sewing-material holder displacement drive:

When the stepping motor 40 is actuated, the toothed-belt pulley 43 rotates, and thus the toothed belt 31 moves so that, as a result of the connection of the portion 30 with the screw-mounting surface 29, the lever 25 and thus the entire slide frame 28 is shifted back and forth in the direction of the X-axis. As is generally known, an exact starting position of the stepping motor 40 and from there a defined movement of travel of the slide frame 28 can be controlled by means of a limit switch, not described in detail.

By an arrangement of the portion 30 and the screw-mounting surface 29 close to the guide bar 21, a swinging movement of the lever 25 and of the slide frame 28 is also possible within limits, the portion 30 being in this connection easily distorted from a neutral position into one or the other direction while still maintaining the permissible tension. In the embodiment described, the permissible displacement of the bar 27 in the direction of the Y-axis is about 20 millimeters, which the sewing-material holder 45 which is received on the bar 27 can thus also carry out. The swingably mounted setting drive 86 does not cause any resistance to such a movement of displacement of the sewing-material holder 45.

As a result of the cooperation of the roller 84 arranged on the base plate 3 and the curved slot 70 on the sewing-material holder 45, the movement of the sewing-material holder 45 in the direction of the Y-axis is fixed in form-locked position, i.e., predetermined by the course of the curved slot 70. There is thus an X-Y control of the sewing material holder 45 in which movement in the direction of the Y-axis is determined by the curved slot 70 and movement in the direction of the X-axis can be programmed.

c) Sewing Unit

One starts from an initial position of the sewing unit 1 in which the sewing machine 2 is standing still, with presser foot 18 raised and needle 16 positioned in its upper position. Furthermore, the plate 11 is in a retracted end position outside the sewing-material holder 45, the bearing 10 having assumed the position shown in solid lines in FIG. 2.

It is furthermore assumed that, as a result of suitable control of the stepping motor 40, the sewing-material holder 45 is in its end position in the direction of the negative X-axis (toward the right in FIG. 1) and that the setting drive 86 is not acted on by compressed air. By the positioning described of the sewing-material holder 45, the roller 89 is in contact with the high part 80 of the cam 78, i.e., the sewing-material holder 45 has assumed the intermediate position described above.

In this condition of the sewing unit 1, a sewing material part 92 is placed on the plate 11 and then wrapped around the plate 11, as indicated in FIG. 2. For the exact positioning of the sewing-material part 11, stops or visible markings are arranged on the plate 11.

Thereupon the operator advances the plate 11 with the sewing-material part 92 positioned thereon in the direction of the Y-axis (toward the right in FIG. 2) until a specific front end position is reached. To this extent, the plate 11 serves for feeding the sewing-material part 92 into the sewing-material holder 45. The front end position is indicated by the position of the bearing 10 shown in dash-dot lines in FIG. 2. During the feeding, the plate edge parts 54, 55 come into contact with the sewing-material part 92 on the plate 11 and, in this connection, move away against the initial tension prevailing in the straps 56 to 59. In this way, the plate edge parts 54, 55, which rest resiliently against each other, come during transport into frictional contact with the sewing-material part 92 so as to smooth the latter, and then receive it between them in clamping fashion. The further result is that the sewing-material part 92 is uniformly pulled around the edge 12 of the plate 11 and thus, consistent conditions are created for the production of the seam which follows.

After a control command, the control 91 then causes compressed air to act on the setting drive 86 so that the sewing-material holder 45 changes its condition from the intermediate position into the clamping position. Thereupon the plate 11 is pulled back into the aforementioned retracted end position so that the sewing-material part 92 is clamped between the clamping plates 46, 49 or the clamping zones 60*a* and the plate edge parts 54, 55. The sewing-material part 92 is readily transferred to the sewing-material holder 45 as a result of the polished surface of the plate 11.

After a control command, the control unit 91 causes a rotation of the stepping motor in clockwise direction as seen in FIG. 1. Thus, the sewing-material holder 45 is moved in the positive direction of the X-axis, toward the left in FIG. 1. In this connection the roller 89 rolls under continuous force of the setting drive 86 from the high part onto the low part 79 of the cam 78, while the piston rod 87 emerges further as a result of the action of the compressed air from the setting drive 86. Finally, the sewing-material holder 45 and the sewing-material part 92 clamped therein reach a position in which the needle 16 is located above a predetermined starting point 93 of the seam 61 to be produced.

In this position, the control 91 lowers the presser foot 18 into the opening 66. This moment is shown in FIG. 2, the sewing-material part 92 which is clamped in the sewing-material holder 45 being shown in dashed lines for ease in understanding. Thereupon the control 91 causes the operation of the sewing machine 2 by the positioning motor 2a and simultaneously controls the stepping motor 40 to move the holder 45 in the direction of the X-axis. During the sewing operation, a movement in the direction of the Y-axis is imposed upon the sewing-material holder 45 by the cooperation of the roller 84 and the curved slot 70, which movement, superimposed upon the movement of the sewing-material holder 45 in the direction of the X-axis, results in the predetermined course of the seam 61.

During the production of the seam 61, the roller 89 rolls along the low part 79 of the cam 78 during which the entire setting drive 86 carries out a swinging movement around the bolt 85. The production of the seam 61 continues until the needle 16 is at an end point 94, at which time the motors 2a and 40 are stopped and a thread-cutting process has been previously carried out. The sewing machine 2 is now in a condition in which the needle 16 is in its upper position and the presser foot 18 is also in its raised position.

Thereupon, the control unit 91 causes a reversal of the setting drive 86, as a result of which the sewing-material holder 45 changes its position from the clamped position into the free position. Thereupon the sewing material 92 provided with the seam 61 is removed, so that the sewing-material holder 45 is in the condition shown in FIG. 4.

The control unit 91 then gives a command for the stepping motor 40 to turn in its counterclockwise direction as seen in FIG. 1. As in the sewing movement described above, the lower clamping plate 46 of the sewing-material holder 45 again passes along the resting surface 6 toward the right in FIG. 1 until the high part 80 of the cam 78 is under the rotating roller 89. In this position the pressure plate 62 is pressed downward so that the sewing-material holder changes its condition from the free position into the intermediate position. After the end position has been reached, the stepping motor 40 is stopped. Thus the starting condition is again finally reached in which a new sewing-material part 92 to be sewn can be fed into the sewing-material holder.

When the sewing-material part 92 comprises certain smooth materials, it may be advantageous to apply friction-increasing strips 95 (FIG. 4) such as an adhesive covering to the clamping plates 46, 49 in the region of the clamping zones 60*a*.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A sewing unit for producing a seam in a sewing-material part, comprising:

a sewing machine, a sewing-material holder, which is mounted displaceably in the unit relative to the sewing machine, a setting drive arranged in the unit for placing the sewing-material holder in an open condition in which the sewing-material part is not grasped and a clamping condition in which the sewing-material part is grasped, and a feeding plate arranged in the unit for feeding the sewing-material part into the sewing-material holder with the sewing-material part folded around the feeding plate, and the feeding plate being movable in a feeding direction into the sewing-material holder in its open condition with the sewing-material part, and out from the sewing-material holder in its clamping condition after removal of the sewing-material part from the feeding plate, the sewing-material holder including upper and lower plate edge parts which are resiliently urged toward each other and thereby frictionally engage the sewing-material part as the sewing-material part is moved between them in said feeding direction by the feeding plate.

2. A sewing unit according to claim 1, wherein the sewing-material holder further has upper and lower clamping plates which are movably arranged in the unit with respect to each other and have respective clamping zones which define a region of the seam to be produced, the clamping plates being arranged beyond the plate edge parts in said feeding direction.

3. A sewing unit according to claim 2, wherein the plate edge parts are connected by flexible straps to the corresponding clamping plates.

4. A sewing unit according to claim 2, wherein each said clamping zone bears an adhesive covering arranged for frictionally engaging the sewing-material part.

5. A sewing unit according to claim 3, wherein the sewing-material holder defines clamping zones which extend on both sides of the seam to be produced, and each said clamping zone bears an adhesive covering arranged for frictionally engaging the sewing-material part.

6. A sewing unit according to claim 2, wherein the plate edge parts are arranged in the unit such that in the open condition of sewing-material holder, the plate edge parts can be brought into a position out of contact with each other.

7. A sewing unit according to claim 6, wherein the setting drive is a three-position drive which is capable of positioning of the clamping plates into an intermediate position in which the plate edge parts, but not the clamping plates, come into contact with the sewing-material part.

8. A sewing unit according to claim 6, wherein the plate edge parts are connected by flexible straps to the corresponding clamping plates.

9. A sewing unit according to claim 8, wherein the clamping plate, the straps, and the plate edge parts are part of a single piece of sheet metal.

10. A sewing unit according to claim 8, wherein the straps are leaf springs.

11. A sewing unit according to claim 10, wherein the clamping plate, the straps, and the plate edge parts are part of a single piece of sheet metal.

12. A sewing unit according to claim 1, wherein the setting drive is a three-position drive which is capable of positioning of the clamping plates into an intermediate position in which the plate edge parts, but not the clamping plates, come into contact with the sewing-material part.

13. A sewing unit according to claim 12, wherein the three-position drive has a pneumatic cylinder with a piston rod which engages a control cam secured on one of the clamping plates.

* * * * *